United States Patent [19]

Bodnar

[11] 4,059,000

[45] Nov. 22, 1977

[54] ROTARY EMBOSSER AND PROCESS OF EMBOSSING STRIP SHEET METAL

[76] Inventor: Ernest Robert Bodnar, R.R. 1, Kingsworth Road, Kingcross Estates, King City, Ontario, Canada

[21] Appl. No.: 717,659

[22] Filed: Aug. 25, 1976

[30] Foreign Application Priority Data

Aug. 29, 1975 Canada ..... 234609

[51] Int. Cl.[2] ..... B21D 22/08

[52] U.S. Cl. ..... 72/197; 72/196; 72/465

[58] Field of Search ..... 72/190, 191, 196, 197, 72/465; 101/22, 23

[56] References Cited

U.S. PATENT DOCUMENTS

| | | | |
|---|---|---|---|
| 2,231,171 | 2/1941 | Randecker | 101/23 |
| 3,150,707 | 9/1964 | Howell | 72/465 |
| 3,188,948 | 6/1965 | Fischer et al. | 101/23 |
| 3,673,838 | 7/1972 | Clempson | 72/196 |

*Primary Examiner*—Lowell A. Larson

[57] ABSTRACT

A rotary embosser for embossing strip sheet metal and having a male embossing roll having a series of upstanding die formations thereon around which the sheet metal runs. One or more indentation rolls having a resilient roll surface are arranged to run in pressurized contact with said embossing roll, said resilient surface being sufficiently resilient to permit indentation of said resilient surface by said male die formations. One indentation roll may be arranged to run in contact with the embossing roll at a point around the circumference thereof spaced down stream from the contact between said embossing roll and the other indentation roll thereby applying tension and pressure to the strip thereby holding the strip in position as it passes around the embossing roll. Tension roll means is arranged upstream around which said sheet metal strip runs, whereby said sheet metal strip is maintained in tension as it passes around both the indentation roll and said embossing roll.

In some circumstances it may be sufficient merely to pass the strip between one indentation roll, and the embossing roll and still achieve a sufficient degree of indentation.

A process for the rotary embossing of sheet metal is also disclosed.

13 Claims, 11 Drawing Figures

ROTARY EMBOSSER AND PROCESS OF EMBOSSING STRIP SHEET METAL

The present invention relates to the rotary embossing of strip sheet metal.

BACKGROUND OF THE INVENTION

The rotary embossing of continuous strip material has usually been carried on in the past by passing the strip material through a pair of embossing rollers. The embossing rollers were usually manufactured of steel or the like and had complementary mating male and female formations for making indentations in the strip material.

This type of procedure worked relatively satisfactorily for soft material such as paper etc., however, it was not entirely satisfactory for the embossing of continuous strip sheet metal. Accordingly, it has been proposed to emboss continuous strip sheet metal such as thin steel strip by subjecting the steel strip to the action of complementary male and female embossing rolls, while maintaining the strip under tension between sets of tensioning rolls located up stream and down stream of the embossing rolls. One such system is disclosed in Canadian Pat. No. 820,611 dated Aug. 19, 1969 inventor Ernest R. Bodnar.

In such a system however it was necessary to manufacture the down stream set of tension rolls as that they fitted into the indentations already embossed by the embossing rolls. In addition it was necessary that the down stream set of tension rolls should be precisely synchronized with the embossing rolls so that the die formations of the tensioning rolls fitted within the indentations already formed in the steel strip by the embossing rolls. Consequently, it was a relatively expensive structure, and one which required to be carefully set up and adjusted to run satisfactorily.

It has also been proposed to form such transverse indentations without subjecting the steel to tension, see for example U.S. Pat. No. 3,137,922, Schumacher. This process however was not satisfactory since the steel strip tended to be distorted by the embossing action of the embossing rolls.

The end product of such a system namely embossed strip sheet metal is possessed of many desirable qualities. For example, it is inherently more rigid than flat sheet material. In addition, it may be provided with an attractive surface patterning, and it may be desirable for a variety of other reasons.

BRIEF SUMMARY OF THE INVENTION

The invention seeks to overcome the foregoing and other disadvantages by the provision of a rotary embosser for embossing strip sheet metal and having a male embossing roll having a series of upstanding die formations thereon around which the sheet metal runs. One or more indentation rolls having a resilient roll surface are arranged to run in pressurized contact with said embossing roll, said resilient surface being sufficiently resilient to permit indentation of said resilient surface by said male die formations. Tension roll means is arranged upstream of said die receiving rolls around which said sheet metal runs, whereby said sheet metal strip is maintained in tension as it passes around both said die receiving rolls and said embossing roll.

In accordance with a particularly preferred form of the invention an indentation roll will be operated so that it has a peripheral rotational speed slightly in excess of the rotational speed of said embossing roll whereby to provide a continuous rubbing action on the surface of the sheet metal whereby to increase the tension applied thereto.

Preferably, the tension roll means located upstream will also be provided with resilient surfaces whereby to provide a greater frictional grip on the sheet metal passing therearound, and are permitted to run against a braking force whereby to apply a retarding force to the strip sheet metal.

In accordance with a further feature of the invention, the embossing roll is mounted for rotation on fixed centers. Adjustable means are provided for adjusting the pressure applied by the indentation rolls to the embossing roll to provide a suitable quality of end product.

According to a further feature of the invention, one of the indentation rolls is driven by gearing connected with said embossing roll, at a speed slightly faster than that of the rotation of said embossing roll, and is adjustably mounted so that minor adjustments to the pressure applied on the strip, may be made.

According to a still further feature of the invention, the embossing roll is preferably driven directly through suitable motorized drive means, and there being a clutch mechanism associated with said embossing roll drive, and a drive take off gear connected with said clutch means, said drive take off gear being in turn connected with said tensioning means upstream of said die receiving roll whereby the drive applied to said tension means may be adjusted without affecting the drive to said embossing roll.

Preferably, a nip roll will be associated with said upstream tension roll means whereby to increase the frictional contact between said tension roll means and said sheet metal strip.

In accordance with one variation of the invention, the entire rotary embosser unit may be mounted on a slidable carriage whereby it may be slid sideways with respect to the path of the strip sheet metal. In this way, the rotary embosser may be added to an already existing sheet metal treatment line.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described pereferred embodimets of the invention.

DESCRIPTION OF A SPECIFIC EMBODIMENT

Figure 1:
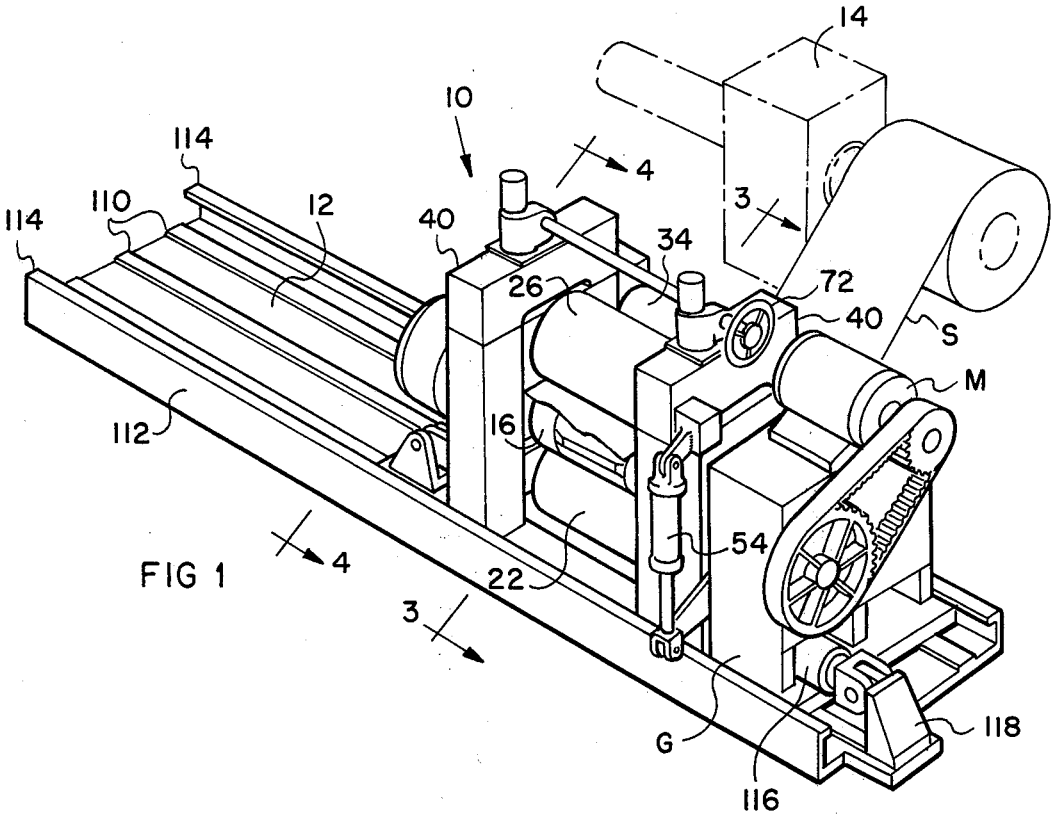
FIG. 1 is a perspective illustration showing a general view of the rotary embosser according to the invention.

Referring now to FIG. 1, it will be noted that the embossing unit according to the invention is shown by the general reference arrow 10. It is shown mounted on a base 12, and it is located in a sheet metal working line of which only one portion is shown in phantom namely an uncoiler 14. The sheet metal shown as S in this preferred embodiment of the invention is thin gauge sheet steel, although it will be appreciated that other materials may be treated in accordance with the invention.

It will of course be appreciated that the entire metal strip processing line is not shown. It may of course include other items of equipment such as conventional roller die stands for rolling longitudinal formations in side edge portions of the strip S, and may also incorporated a cut to length flying shear mechanism, or any other pieces of equipment that may be required. The entire processing line is of course omitted from the present illustration for the sake of clarity.

Figure 2:
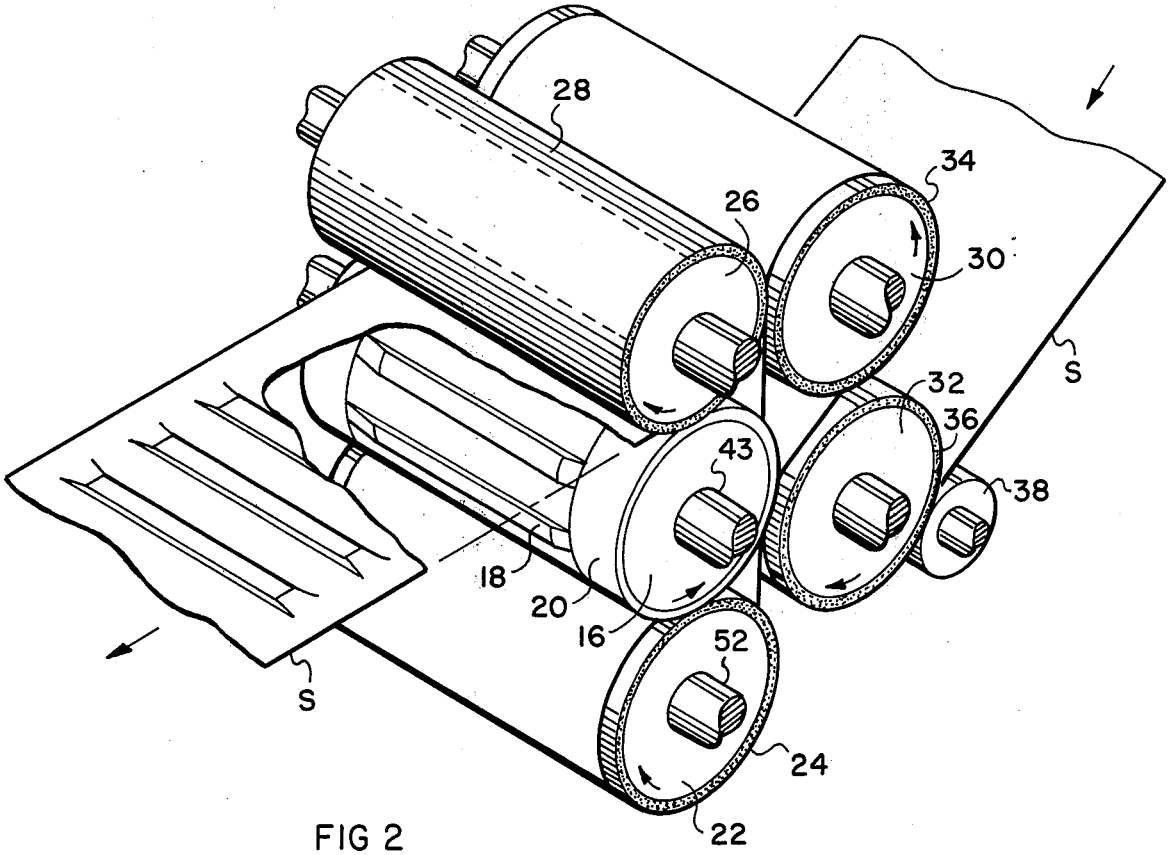
FIG. 2 is an enlarged schematic view showing the arrangement of rolls, and the path of sheet metal therearound.

As better shown in FIG. 2, the embossing unit 10 comprises a male embossing roll 16 having on the center portion of its surface a series of upstanding male die formations 18, and having smooth cylindrical side surface portions 20. A lower indentation roll 22 or first female roll is provided having a resilient surface 24 for receiving the die formations 18 to be described in more detail below.

The surface 24 is in pressurized contact with the embossing die 16.

An upper indentation roll 26 or second female roll is also provided, having a similar resilient surface 28 in pressurized contact with the embossing roll 16, which also receives the die formations 18.

A tension roll bridle assembly is provided comprising upper and lower bridle rolls 30 and 32 each of which has a resilient surface 34 and 36 respectively.

A nip roll 38 is provided in pressurized contact with the surface of the lower bridle roll 32. The strip S passes first of all between the nip roll 38 and the lower bridle roll 32 then upwardly around the upper bridle roll 30 and then downwardly around the indentation roll 22 and then around the embossing roll 16.

The details of the embossing unit 10 will now be described in relation to FIGS. 3 to 10 in more detail.

Figure 3:
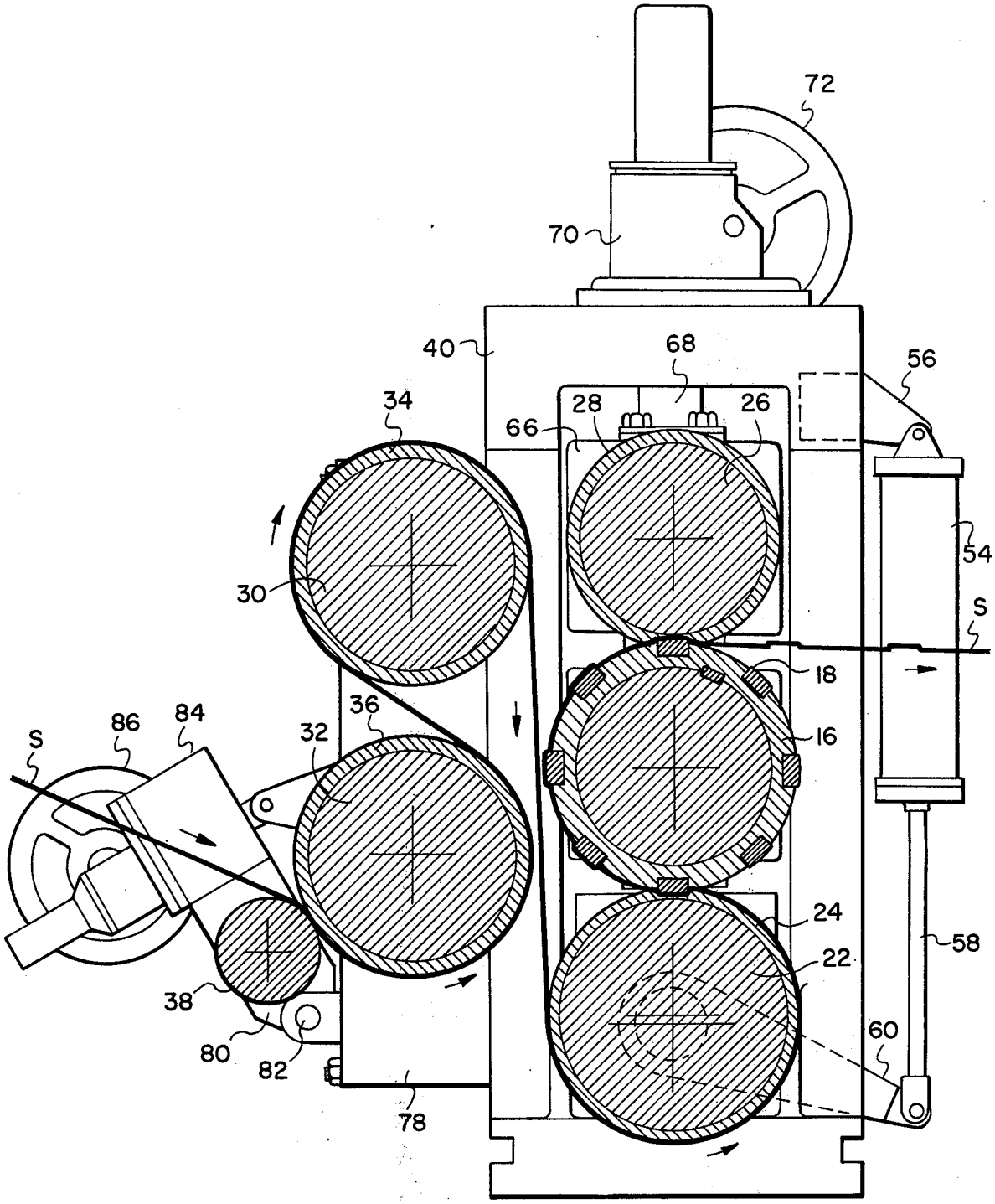
FIG. 3 is a sectional side elevational view of the embossing unit shown along the line 3—3 of FIG. 1.

Referring now to FIG. 3, it will be seen that the three rolls namely embossing roll 16, indentation roll 22, and indentation roll 26 are all mounted in vertical alignment with one another in common frames 40. As shown in more detail in FIG. 6, there are two such frames 40, one for each end of the rolls.

It will be noted that the embossing roll 16 is mounted in fixed location in the frame 40 being carried on shaft 43 running in bearings 44. The indentation roll 22 is adjustably mounted in the block members 46 which are rigidly mounted in the frames 40, and are provided with bushings 48.

The indentation roll 22 is rotatably mounted as by bearings 50 on a central shaft 52 whereby the roll 22 is free to rotate in contact with the embosser roll 16. The shaft 52 has journals 53 which are located on centers which are offset with respect to the central axis of the shaft 52. In this way, rotation of the journals 53 will cause the shaft 52 to move either towards or away from the embosser roll 16.

In order to control the adjustment of the shaft 52, there is provided a hydraulic cylinder 54 which at its upper end is swingably mounted on a gusset plate 56 attached to one of the frames 40, the cylinder 54 being thus free to swing relative to the plate 56.

The piston rod 58 extending from the cylinder 54 is connected at its lower end to a lever 60. The opposite end of the lever is connected to one of the journals 53. Thus operation of the cylinder 54 will procure rotation of the journals 53 and shaft 52. By reason of the eccentric location of the journals 53 on the shaft 52, this will then cause movement of the indentation roll 22 either towards or away from the embossing roll 16.

The upper indentation roll 26 is mounted on a shaft 26 which is rotatably mounted in any suitable bearings 64. The bearings 64 are in turn carried in bearing housings 66.

The housings 66 are slidably mounted in the frame 40 and are connected with operating shafts 68 which are connected with a right angle threaded drive system 70. The drive system 70 is manually controlled by means of the hand wheel 72. In this way, by operation of the hand wheel it is possible to apply more or less pressure by movement of the roll 26 towards or away from the embossing roll 16. It will of course be appreciated that the degree of movement provided in this way is relatively limited.

Figure 4:
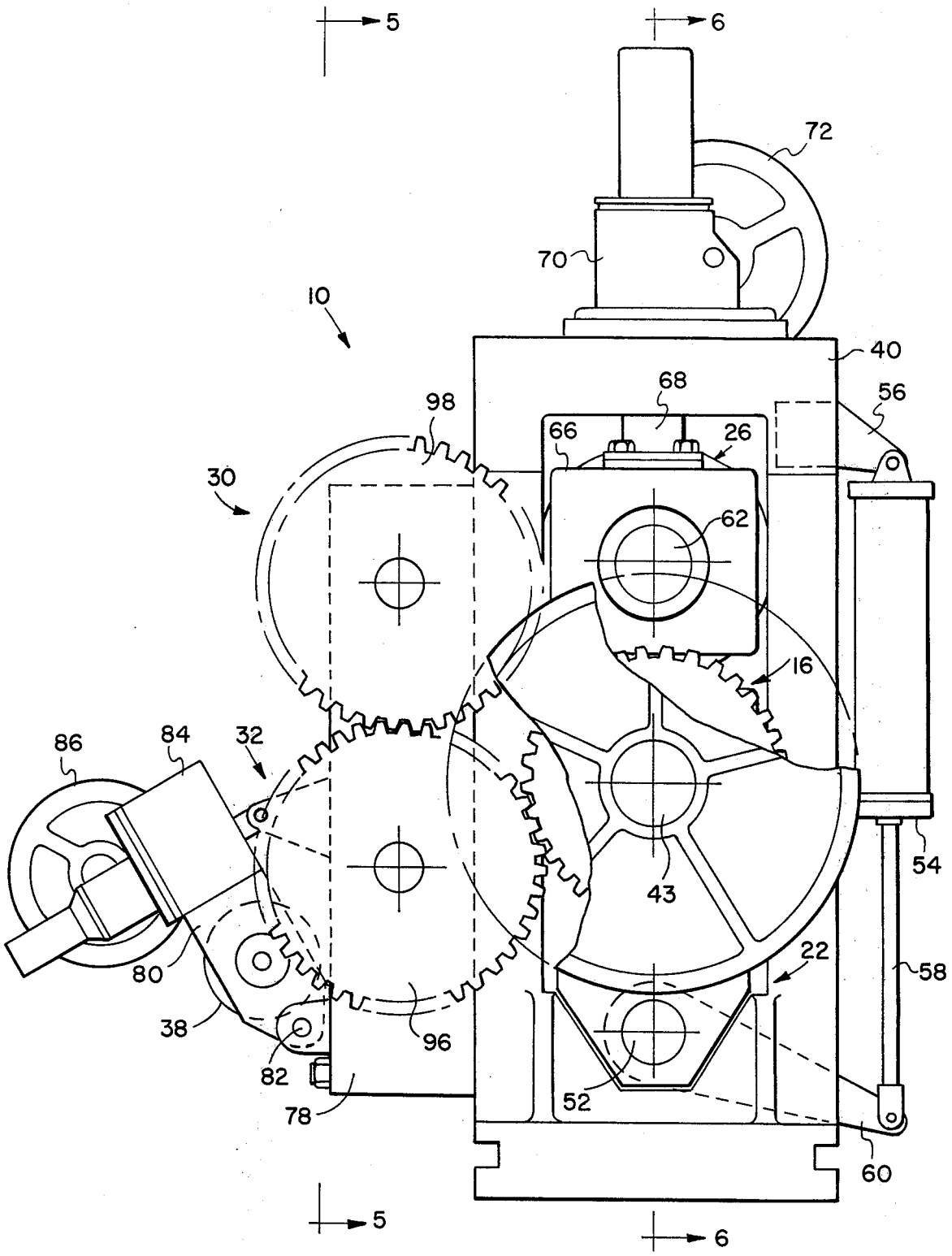
FIG. 4 is a side elevational view partially cut away along the line 4—4 of FIG. 1.
Figure 5:
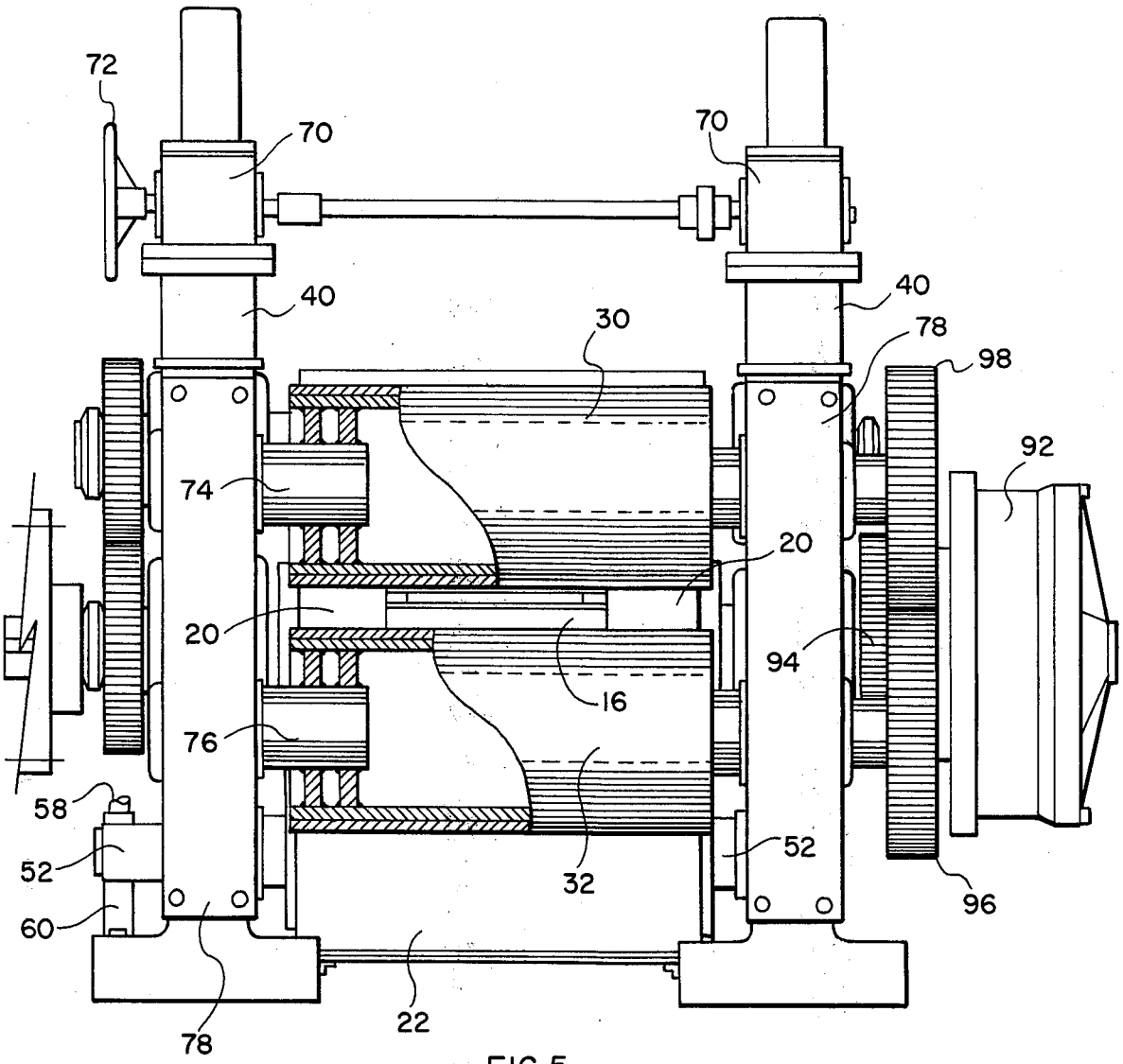
FIG. 5 is an end elevational view partially sectioned along the line 5—5 of FIG. 4.

Both the lower indentation roll 22 and the upper indentation roll 26 are provided with resilient surfaces. These resilient surfaces comprise the treads or sleeves 24 and 28 respectively. Both of these treads are formed in this preferred embodiment of the invention of suitable material such as polyurethane. It will however be appreciated that this is but one of several different suitable compounds which may be used for the purpose. The treads 24 and 28 will be sufficiently resilient that when applied with suitable pressure against the embossing roll 16, they will be capable of being indented by the upstanding dies 18. Bridle rolls 30 and 32 are mounted, as best shown in FIGS. 4 and 5, on respective bridle shafts 74 and 76 which are carried in a pair of sub-frames 78 attached to the upstream side of the frames 40.

As stated above, they have resilient surfaces provided by treads 34 and 36 of polyurethane material, although any other relatively hard resilient material having similar frictional characteristics will be suitable for the purpose.

The nip roll 38 is mounted on a swingable mounting arm 80 attached at the pivot point 82 to the sub-frame 78. By means of a right angle drive system 84 and hand wheel 86, the pressure of the nip roll 38 against the lower bridle roll 32 may be adjusted.

The drive mechanism for the various rolls is best explained with reference to FIGS. 4, 5 and 6.

Figure 6:
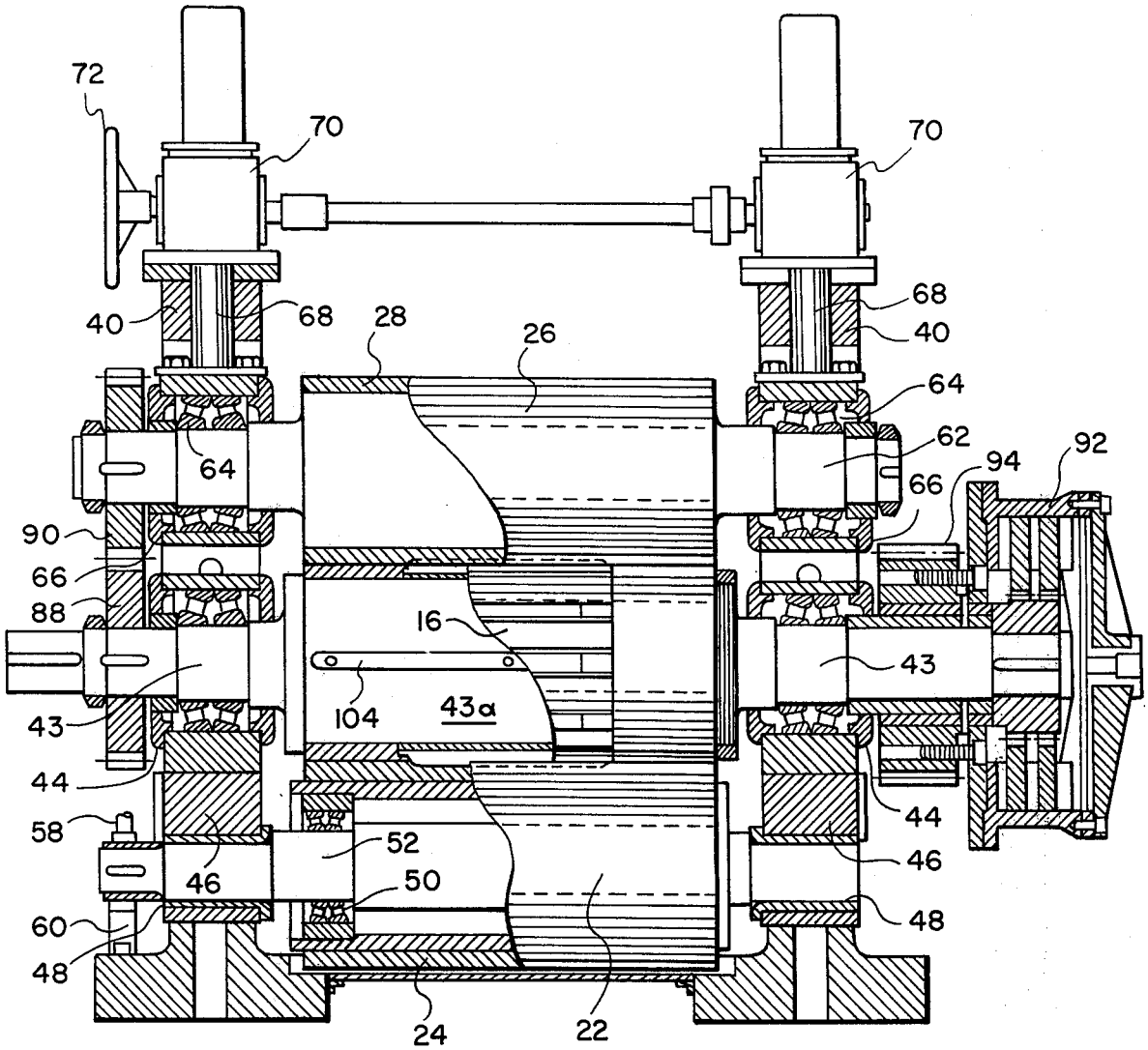
FIG. 6 is a section along the line 6—6 of FIG. 4.
Figure 7:
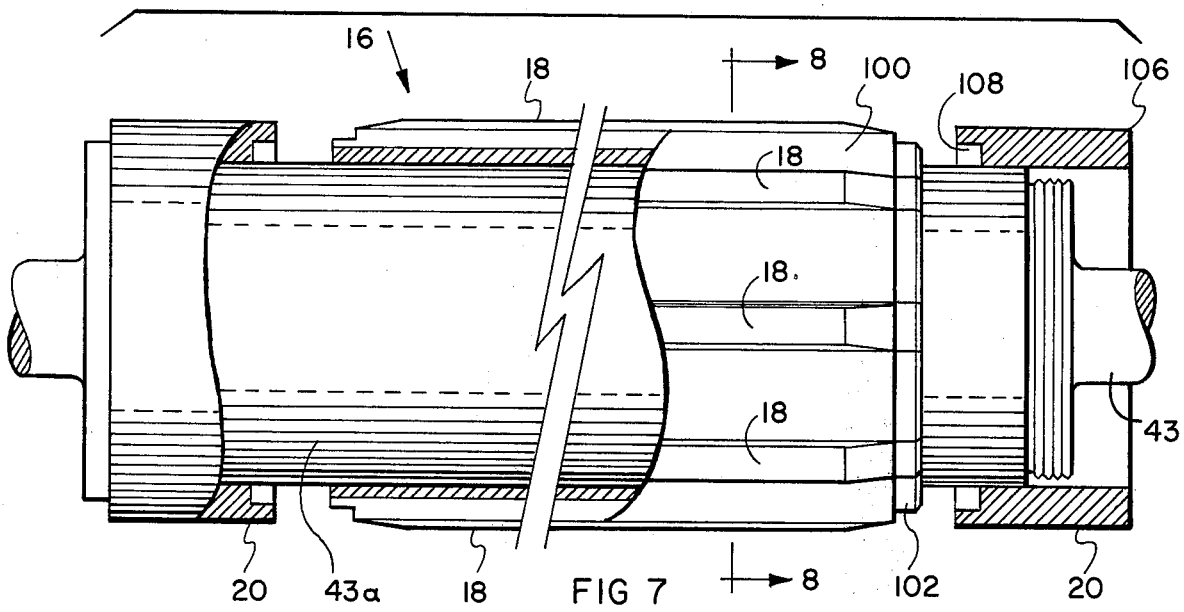
FIG. 7 is an enlarged exploded cut away view.
Figure 8:
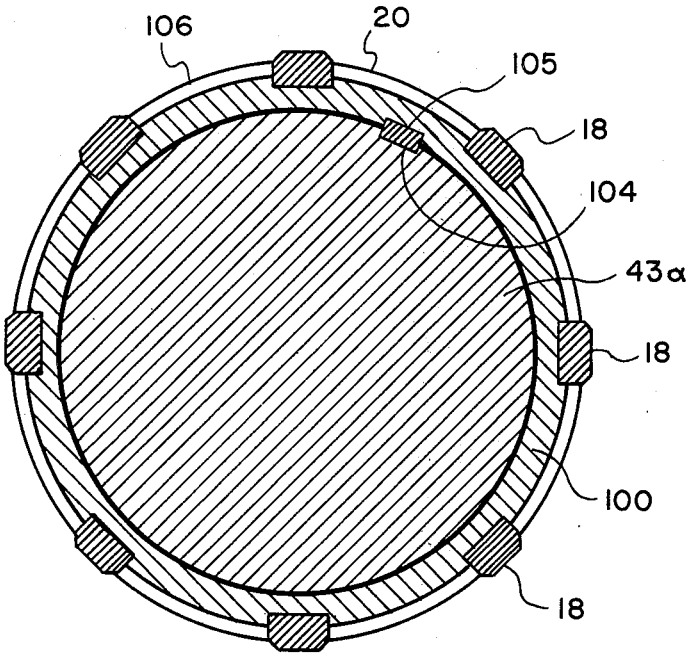
FIG. 8 is a section along the line 8—8 of FIG. 7.
Figure 10:
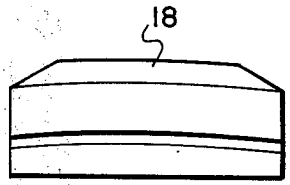
FIG. 10 is an end elevational view of the die element of FIG. 9 sectioned along the line 10—10.
Figure 9:
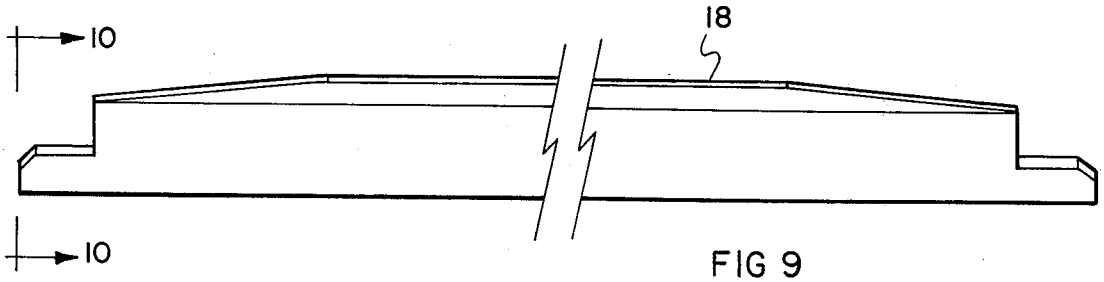
FIG. 9 is a greatly enlarged view of a portion of the embossing roll of FIG. 7.

Referring first of all to FIG. 6, the embosser roll 16 is driven directly through shaft 43 which is coupled to a suitable drive system comprising a motor M and gear box G (see FIG. 1) the details of which are omitted for the sake of clarity.

The drive train for the upper roll 26 is shown in FIG. 6 and comprises a gear wheel 88 keyed to the drive shaft 43 for the main embossing roll 16. A gear wheel 90 is keyed to the shaft 62 of the upper roll 26 and meshes with the gear wheel 88. Gear 90 is slightly smaller than gear 88, and the upper roll 26 is therefore driven at a speed slightly in excess of the speed of the main embossing roll 16. The difference in speed between the two rolls should be relatively slight, and in this preferred embodiment of the invention, the diameter of the upper roll 26 is slightly less than the diameter of the main embossing roll 16 so that the difference in speed between the two rolls is not necessarily as great as the difference in speed between the two gears 88 and 90. It will however be appreciated that the difference in speed between the rolls with be established during the design stage of any particular unit so as to be the most suitable for the particular purpose for which that installation is being designed.

The drive train for the bridle rolls 30 and 32 is located at the opposite end of the drive shaft 43 for the main embossing roll 16. Such bridle drive train comprises a clutch 92 driven directly off the drive shaft 43, and a gear 94 bolted to clutch 92. The gear 94 in turn meshes with a gear 96 keyed to the shaft 76 of the lower bridle roll 32. A similar gear 98 is keyed to the shaft 74 of the upper bridle roll 30, and meshes with the gear 96. The gear ratio between the gears 94 and 96 is selected so that the bridle rolls 39 and 32 are driven at a speed slightly slower than the speed of the embossing roll 16.

The nip roll is of course a free running roll and will simply roll at the same speed as the lower bridle roll 32.

The lower indentation roll 22 is also a free running roll and will therefore rotate at the same speed as the main embossing roll 16.

The clutch 92 is operated so as to slip slightly in such a manner as to permit the bridle rolls and 32 to rotate slightly faster than the speed at which the drive would operate if the clutch were fully engaged. In this way, the sheet metal passing around the bridle rolls 30 and 32 is subjected to a braking action, but the clutch 92 is operated so as to avoid any actual slippage of the sheet metal on the bridle rolls 30 and 32, while applying sufficient retarding torque to maintain the desired tension in the strip.

Referring now to FIGS. 7, 8, 9 and 10, the embossing roll 16 is made up of a central cylindrical portion 100 provided with a series of elongated transverse die members 18 which are recessed into the cylindrical portion 100, the dies 18 being bevelled at each end, in accordance with the design requirements for the finished product.

A reduced diameter neck portion 102 may be formed at each end of the cylindrical portion 100. The cylindrical portion 100 is carried on an enlarged central cylindrical portion 43*a* of the shaft 43, provided with a keyway 104, receiving a key 105.

Cylindrical sleeve portions 106 having collars 108 formed thereon are arranged on each end of the cylindrical support 104, with the collars 108 interfitting over the necks 102.

The surfaces of the cylindrical portions 106 are smooth and are referenced as 20.

As best shown in FIG. 1, the base 12 in this case, preferably extends out to one side of the embossing unit 10. The base 12 is provided with a series of rails 110 on which the frames 40 of the unit 10 are supported. A pair of side walls 112 extend upwardly from the base 12 and at their upper ends, are provided with in turned retaining flanges 114. The flanges 114 fit around webs (not shown) on the frame 40. The entire embosser unit 10 is thus slidable from side to side along the base 12.

In order to move the embosser unit 10 to and fro, a hydraulic cylinder 116 is fastened with one end operatively connected to the embosser unit 10, and the other end fastened to a stop 118 on the base 12. In this way, if the rest of the components on the sheet metal working line may be used for some other purpose, then the embosser unit 10 may be slid to one side.

This additional feature is not fundamental to the invention but is merely an added convenience.

In operation, in the preferred form of the invention strip sheet metal is arranged around the various rollers as shown in FIG. 2. The motor M, through the gear box G is then operated to drive the drive shaft 43 of the embossing roll 16. Rotation of the shaft 43, will also procure rotation of the gears 88 and 90, thereby driving the upper roll 26. Rotation of the drive shaft 43 will also procure rotation of the clutch 92, and, assuming the clutch 92 is engaged then it will also rotate the gear 94 thereby driving the gears 96 and 98 and causing the rollers 30 and 32 to rotate.

As the sheet metal passes around the bridle roll of 32 and 30, it is frictionally engaged and subjected to a retarding or braking force, since the bridle rollers 30 and 32 are subjected to a retarding torque relative to the embossing roller 16.

The metal strip passes from the upper bridle roll 34 vertically downwardly around the indentation roll 22 and it then passes between indentation roll 22 and around embossing roll 16. As the dies 18 successively engage the metal strip, the strip will be indented into the resilient surface or tread 24 of the roll 22 thereby indenting successive transverse formations conforming to the shape of the male dies 18.

Each indented portion of sheet metal will remain in engagement with its respective die 18 as the strip passes around the roll 16, and will then be engaged by the upper roll 26. The resilient surface or tread 28 of the roll 26 will again permit the sheet metal and die 18 to be indented into the roll.

As mentioned above, the roll 26 will usually be rotating slightly faster than the roll 16. As a result, the roll 26 will apply either a rubbing action, or simply pressure on the surface of the sheet metal strip, which effectively maintains the strip in a tight wrap around the roll 16 and the male dies 18 and prevents any tendency for the transverse formations already indented into the metal strip to become disengaged from their dies 18.

Depending upon the requirements of the type of metal strip, and the particular shape of the end product, the pressure exerted by the rolls 22 and 26 may be increased or decreased by means of the cylinder 54 in the one case and the hand wheel 72 in the other case.

The speed of the bridle rolls 30 and 32 will be controlled by slipping of clutch 92. The objective is to cause the rolls 30 and 32 to apply a retarding force to the strip, without actually permitting slipping of the strip on the rolls 30 and 32. In other words the strip, under the pull of the embossing roll 16, will attempt to drive the rolls 30 and 32 faster than they are being driven by gears 94, 96 and 98, and the clutch 92 is slipped just enough to permit this increase in speed. The less the clutch 92 is allowed to slip, the greater the tension in the strip, so long as no slippage takes place between the strip and the rolls 30 and 32.

The speed differential between the embossing roll 16, and the upper roll 26 will be relatively small. It will be to some extent regulated by the operation of the hand wheel. As the pressure of the roll 26 on the roll 16 is increased, it will compress the tread 28 and thereby decrease the effective diameter of roll 26. This will tend to equalize the speeds of rolls 26 and 16. In some cases the roll speeds may in fact be equal and no slippage will take place.

It will thus be seen that by the use of a resilient tread or tires 24 or 28, it is possible to carry out continuous embossing of strip sheet metal without the need for precisely meshing male and female embossing die rolls, as was previously thought to be necessary. In addition, by the use of a down stream tensioning roll in the form of the roll 26, having a resilient tread 28, it is possible to maintain tension in the strip without the necessity of having tensioning rolls having die formations corresponding to the embossing die formations, and precisely synchronized so as to interfit with the impressions already made in the strip metal by the embossing dies. Furthermore, by the empolyment of a drive system in which one of the indentation rolls is driven slightly faster than the embossing roll, any tendency for the sheet metal to strip on the embossing die on the embossing roll is eliminated.

The down stream roll 26 holds the strip wrapped firmly in engagement with the die roll 16 around a predetermined arc, in this case about 180°, of the roll 16. This effectively prevents distortion of the transverse formations, on the flat side edge portions of the strip material.

In addition, by the use of a slipping drive on the upstream tensioning means namely the tensioning bridle, it is possible to maintain a tension in the strip, by a braking action on the strip, in which the retarding torque may be adjusted simply by adjustment of the degree of engagement of the clutch.

Other forms of retarding action could be employed such as a brake, controlling the bridle rolls 30 and 32. However the reduced speed drive, and slipping clutch as disclosed, is found to be an effective method, in practice.

At the same time the flat side portions of the strip S are effectively held flat at all times by the pressure of the indentation roll 22 and upper roll 26, on the sheet metal while it is on the embossing die 16.

In accordance with another mode of operation, the path of the sheet metal strip may be simplified and shortened.

In the preferred form of operation the strip passes both around lower roll 22 and then between roll 16 and upper roll 26. This holds the strip securely during indentation and produces a flat, even, metal panel.

However, in some cases a panel having an uneven or stressed configuration is acceptable and may conceivably be desirable, depending upon the end use of the panels.

Figure 11:
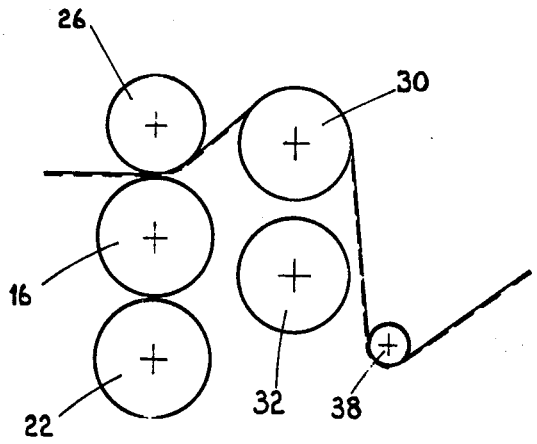
FIG. 11 is a schematic illustration of an alternated form.

In this case it is possible to run the strip S as shown in FIG. 11. The strip will now run around nip roll 38, past roll 32 without contacting it, and around roll 39 with a wrap of slightly more than 90°.

The strip then passes between the nip of upper roll 26 and embossing roll 16, without contacting lower roll 22 at all. Roll 22 can in fact be lowered so as to disengage from roll 16. The strip may have a wrap of about 45° around upper roll 26 as it passes from roll 30.

Considerably less tension will be created in the strip in this mode of operation. This may be desirable for certain types of strip material, although the end product is likely to show stress marks, or be uneven or warped, due to the lack of tension.

The foregoing is a description of a preferred embodiment of the invention which is given here by way of example only. The invention is not to be taken as limited to any of the specific features as described, but comprehends all such variations thereof as come within the scope of the appended claims.

The embodiments of the invention in which an exclusive property or privilege is claimed are defined as follows:

1. Apparatus for the continuous formation of transverse indentations in strip sheet material, such as strip sheet steel or the like said apparatus comprising;

male die roll means having a plurality of transverse upstanding male die formations thereon and adapted to be driven at a predetermined speed;

a first female roll member engaging said male die roll means under pressure and having a resilient surface deformable by indentation of said male die formations of said male die roll means into said resilient surface, said strip material passing between said male die roll means and said first female roll member and being thereby indented into said resilient surface;

a second female roll member having a resilient surface which is in pressurized contact with said male die roll means at a point thereon spaced from said first female roll member downstream with respect thereto, said resilient surface being deformed by pressure between said second female roll member and said male die roll means, and said strip material passing therebetween, said resilient surface applying pressure to said strip material, thereby holding the strip material in position against said male die roll means, around a predetermined arc thereof, and maintain said male die formations in contact therewith all around said arc, and, upstream tension roll means for engaging said strip material prior to passage between said male die roll means and said first female roll member.

2. Apparatus as claimed in claim 1 wherein each of said female roll members comprises a metallic roll member, and a tread of resilient deformable material attached therearound, having a depth and degree of resilience sufficient to receive said die formations therein.

3. Apparatus as claimed in claim 2 wherein said tread is formed of polyurethane material.

4. Apparatus as claimed in claim 2 wherein at least one said female roll member is adjustable towards and away from said male die roll means whereby to increase or decrease the pressure developed therebetween.

5. Apparatus as claimed in claim 4 including a shaft for mounting a said first female roll member, eccentric journals on said shaft, bearing means for receiving said journals, and an operating arm rotating said journals in said bearing, rotation of said journals procuring movement of said shaft, and said firsr female roll members mounted thereon, towards or away from said male die roll means.

6. Apparatus as claimed in claim 1 wherein said upstream tension roll means include a pair of bridle rolls around which said strip sheet metal runs, and means for applying a retarding force to said bridle rolls whereby to retard said strip, thereby tensioning the same between said bridle rolls and said male die roll means.

7. Apparatus as claimed in claim 6 including drive means for driving said bridle rolls at a predetermined speed, less than the speed of said male die roll means, and including clutch means in said drive means, said clutch means being adapted to be adjusted whereby to permit said bridle rolls to rotate at a speed faster than said predetermined speed at which they are driven, in response to the pull of said strip sheet metal as the same runs therearound.

8. Apparatus as claimed in claim 1 including drive means driving said second female roll member at a predetermined speed greater than the speed of said male die roll means.

9. Apparatus as claimed in claim 8 wherein said second female roll is adjustably movable towards and away from said male die roll means whereby to increase or decrease the pressure developed therebetween.

10. Apparatus as claimed in claim 1 wherein said first female roll member rotates at the same speed as said male die roll means and including drive means for said second female roll member driving same at a speed greater than that of said male die roll means.

11. The process for the continuous formation of transverse indentations in strip sheet metal such as strip sheet steel or the like, said process comprising;

continuously passing strip sheet metal between a male and first female rolls, said male roll having upstanding male die formations thereon, and said first female roll having a resilient deformable surface in pressurized engagement with said male role and being indented by said upstanding male die means, thereby forming said transverse formations in said strip sheet material into said resilient surface;

simultaneously applying a retarding force to said strip sheet metal upstream of said rolls;

subsequently passing said strip sheet metal between said male die roll and a second female roll located downstream of said first female roll and having a resilient surface indented by said male die formations, and strip sheet metal thereon;

said male and female rolls applying tension to said strip sheet metal against said retarding force, and maintaining said strip sheet metal in engagement with said upstanding male die means around a predetermined arc of said male roll whereby to prevent slippage of said strip sheet material relative to said upstanding male die means.

12. The process as claimed in claim 11 wherein said retarding force is provided by passing said strip sheet material around bridle roll means, said bridle roll means being subjected to a retarding force whereby to tension said strip between said bridle roll means and said male and female rolls.

13. The process as claimed in claim 11 including the step of driving said second female roll at a peripheral speed slightly in excess of the peripheral speed of the male die roll.

* * * * *